US006811057B2

(12) United States Patent
Duquet et al.

(10) Patent No.: US 6,811,057 B2
(45) Date of Patent: Nov. 2, 2004

(54) FLUID DISPENSER ASSEMBLY

(75) Inventors: Frédéric Duquet, Evreux (FR); Hervé Pennaneac'h, Verneuil sur Avre (FR)

(73) Assignee: Valois S.A.S., Le Neubourg (FR)

( * ) Notice: Subject to any disclaimer, the term of this patent is extended or adjusted under 35 U.S.C. 154(b) by 72 days.

(21) Appl. No.: 10/108,546

(22) Filed: Mar. 29, 2002

(65) Prior Publication Data

US 2003/0000962 A1 Jan. 2, 2003

Related U.S. Application Data

(60) Provisional application No. 60/291,024, filed on May 16, 2001.

(30) Foreign Application Priority Data

Mar. 30, 2001 (FR) ..... 01 04327

(51) Int. Cl.[7] ..... B65D 35/056
(52) U.S. Cl. ..... 222/105; 222/107; 222/215
(58) Field of Search ..... 222/93, 105, 107, 222/153.06, 630–633, 153.07, 187, 215

(56) References Cited

U.S. PATENT DOCUMENTS 2,331,842 A * 10/1943 Moran ..... 222/633
3,028,986 A * 4/1962 Cushman ..... 217/3 R
3,469,743 A * 9/1969 Becker ..... 222/105
6,082,585 A 7/2000 Mader et al.
6,460,781 B1 * 10/2002 Garcia et al. ..... 239/327
6,540,079 B1 * 4/2003 Garcia et al. ..... 206/484

FOREIGN PATENT DOCUMENTS

EP 1 013 449 A2 6/2000
FR 2 796 368 1/2001

* cited by examiner

*Primary Examiner*—Gene Mancene
*Assistant Examiner*—Melvin A. Cartagena
(74) *Attorney, Agent, or Firm*—Sughrue Mion, PLLC

(57) ABSTRACT

A fluid dispenser assembly characterized in that it comprises:

a fluid dispenser (1) defining a substantially flat body (10) provided with a dispensing orifice (17) and with a removable closure member (18) suitable for closing the dispensing orifice (17); and packaging (2) encasing the dispenser (1) and forming an opening portion (24, 28; 240, 280) in which the removable closure member (18) is received so that it is possible to take hold of it in order to remove it from the body, thereby unmasking the dispensing orifice.

17 Claims, 2 Drawing Sheets

FLUID DISPENSER ASSEMBLY

CROSS REFERENCE TO RELATED APPLICATION

This application claims the benefit under 35 U.S.C. §119 (e) of pending U.S. provisional patent application Ser. No. 60/291,024, filed May 16, 2001, and priority under 35 U.S.C. §119(a)–(d) of French patent application No. FR-01.04327, filed Mar. 30, 2001.

TECHNICAL FIELD

The present invention relates to a fluid dispenser assembly as used in the fields of perfumes, cosmetics, or indeed pharmaceuticals. In the fields of perfumes and cosmetics, dispensers or dispenser assemblies exist that are, in fact, promotional samples so that a consumer can discover a product. Such samples are generally distributed free of charge. Some such samples are included in magazines, and it is not uncommon there to be three, four, or five samples in the same magazine. The samples must therefore be of very small thickness so as not to increase the thickness of the magazine significantly. Magazines must be suitable for being stacked in the form of vertical pile, and samples contained inside them must not destabilize the pile of magazines.

BACKGROUND OF THE INVENTION

To put the sample in place in the magazine, it is common to use machines in which the samples are firstly placed vertically in a feed bin. A suction-pad system takes hold of the sample situated at the bottom of the bin, and a claw system then takes over from the suction-pad system to take the sample to a pasting station and then to a pressing station so as to paste it onto a page of the magazine. In order to perform that operation of putting samples in place in magazines, it is necessary to take hold of them by means of a suction-pad system. Unfortunately, the suction-pad system can operate effectively only on a surface that is substantially plane, for reasons specific to the suction-pad technique. A suction pad cannot be applied to a surface that is totally uneven. Furthermore, it is also necessary for the samples to be of standard shape, and preferably square or rectangular, so as not to impede their positioning or movement inside the bin, nor their retention by means of the suction-pad system and subsequently by means of the claw system.

Such a dispenser assembly for use as a sample generally includes a fluid dispenser defining a fluid reservoir. Unfortunately, it is difficult to make the reservoir simultaneously both particularly flat and particularly plane. To make reservoir walls that are plane, it is possible to use a shaped-section shell that is advantageously thermoformed. Unfortunately, the thickness of the reservoir is then significant. It is also possible to make a reservoir using two flexible sheets. This considerably reduces the thickness of the reservoir, but it is then not possible to guarantee that the faces of the reservoir are plane.

Furthermore, any fluid dispenser is provided with a dispensing orifice, and, when the dispenser is for use as a sample, the dispensing orifice is often closed off by a removable closure member that can be torn off, detached, or folded back by the consumer so as to unmask the dispensing orifice. It is important that the closure member must not impede sample feeding by means of a machine equipped with a suction-cap and claw system. In other words, while remaining accessible, the removable closure member must not be able to interfere with the operation of a feed machine for taking samples and fixing them in magazines.

The problems of planeness of the faces of the reservoir, and of impediment caused by the removable closure member should not be considered to be specific to samples designed to be included in magazines. For reasons of appearance and for functional reasons, it is also advantageous for the reservoir faces to be plane so that they can bear inscriptions. In addition, it is also advantageous for the removable closure member to be protected even outside a sample, so that the removable closure member is not removed or detached accidentally.

BRIEF SUMMARY OF THE INVENTION

To solve these problems, the present invention provides a fluid dispenser assembly characterized in that it comprises:

- a fluid dispenser defining a substantially flat body provided with a dispensing orifice and with a removable closure member suitable for closing the dispensing orifice; and
- packaging encasing the dispenser and forming an opening portion in which the removable closure member is received so that it is possible to take hold of it in order to remove it from the body, thereby unmasking the dispensing orifice.

The body of the dispenser that defines the fluid reservoir is thus covered by the packaging, and the removable closure member is protected in the opening portion so that it is almost impossible for it to constitute an impediment or encumbrance when manipulating the assembly. In addition, it is very difficult for the removable closure member to be actuated accidentally in its opening portion. The outside walls of the packaging mask the body which, although it is substantially flat, is not exactly plane. By means of this packaging, at least one plane face is obtained, and the removable closure member is protected.

In a first embodiment, the opening portion is provided with a recess in which the removable closure member is received in a manner such as to be visible. In this embodiment, the packaging forms a sort of cut-out in which the removable closure member is visible and can be grasped directly.

In a second embodiment, the opening portion encases the removable closure member at least in part. Advantageously, the opening portion is defined by at least one line of least resistance so that the opening portion can be detached, together with the removable closure member, from the remainder of the packaging. In a variant, or in addition, the opening portion is defined by at least one slot. The opening portion then covers the removable closure member which is then not necessarily entirely visible. To remove it, it suffices to take hold of the opening portion and to tear it off together with the removable closure member.

In a practical embodiment, the packaging is made up of a backing sheet and of a cover sheet, the dispenser being fixed to the backing sheet and the cover sheet being fixed to the backing sheet over the peripheries of said sheets. The backing sheet may advantageously be more rigid than the body of the dispenser, so that it is not subjected to any deformation due to the body being fixed against its inside face. Finally, once the packaging has been assembled, the backing sheet and the cover sheet are only slightly convex due to the substantially flat body of the dispenser being included between them. However, overall, the sheets are substantially plane and suitable for being picked up by means of a suction-pad system. Similarly, the fact that at least one of the two sheets is plane makes it easy for it to bear an indication such as a trademark, the ingredients, and the instructions for use of the fluid. Preferably, the backing sheet and the cover sheet are made integrally and are folded along one side. Advantageously, the recess is situated on said one side. Preferably, the removable closure member lies entirely within the opening portion. In a practical embodiment, the removable closure member is provided with a free edge that extends substantially in alignment with the connection side.

Advantageously, the dispensing orifice is situated on one edge of the opening portion, e.g. on the bottom of the recess or on the line of least resistance.

In a preferred embodiment, the body defines an actuating wall that can be pressed to drive the fluid out through the dispensing orifice, it being possible to actuate said actuating wall through the packaging.

According to another aspect of the invention, the opening portion is formed by a respective cutout of the backing and cover sheets, said cutouts over lapping when said cover sheet is disposed on the backing sheet.

BRIEF DESCRIPTION OF THE DRAWINGS

The invention is described more fully below with reference to the accompanying drawings which show an embodiment of the invention by way of non-limiting example.

In the figures.

DETAILED DESCRIPTION

Figure 1:
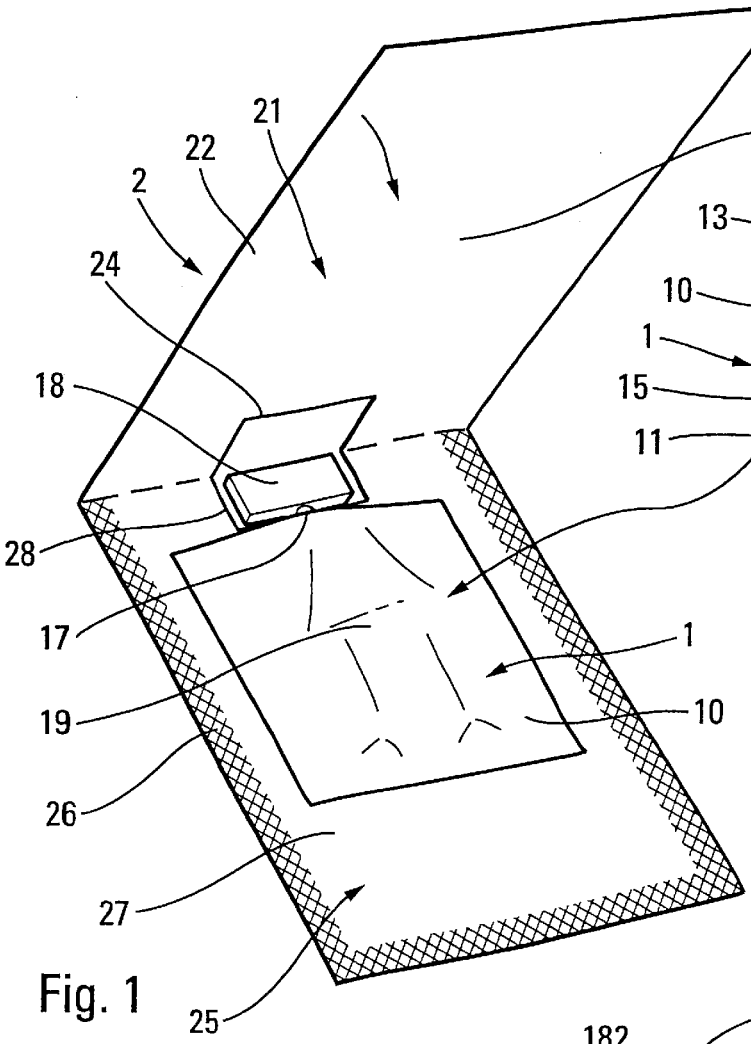
FIG. 1 is a perspective view of a first embodiment of a fluid dispenser assembly while the packaging is being assembled.

In the two embodiments described, the fluid dispenser assembly of the invention is made up of two component elements, namely a fluid dispenser 1 and packaging 2.

The dispenser 1 may, for example, be identical to the dispenser described in FR 2 791 645 which is incorporated herein by reference. The dispenser described in that document may be identical to the dispenser shown in FIG. 2. The dispenser 1 includes a body 10 made up of one or two sheets 11, 12, e.g. of composite film, bonded together over their peripheries. The body 10 thus defines a reservoir 16 containing a small quantity of fluid. A support part 13 is fixed, advantageously by heat-sealing, between the two sheets 11 and 12. This part 13 serves to support a piece of porous material 14 capable of becoming soaked with fluid. The piece of porous material 14 extends from the support part 13 inside the reservoir 16, but it communicates via its end fixed to the support part 13 with a dispensing orifice 17. A spring element 15 is disposed inside the reservoir 16. In addition to the body 10, the dispenser 1 further includes a removable closure member 18 which closes off or masks the dispensing orifice 17. The special feature of this dispenser as described in Document FR 2 791 645 is that the spring element 15 is stressed to the maximum extent so as to define a minimized reservoir volume so long as the removable closure member 18 is not removed from the body 10. This guarantees that the body 10 of the dispenser has a substantially flat shape which is not more than two millimeters thick. As soon as the removable closure member 18 is removed, air can penetrate into the reservoir 16 through the dispensing orifice 17, and through the piece of porous material 4. The reservoir 16 then contains a small quantity of fluid and a large quantity of air, which makes it possible to perform two-phase dispensing through the piece of porous material and through the dispensing orifice 17. Good spraying quality is thus guaranteed. This is merely a particular embodiment for the fluid dispenser. It is quite possible to consider other embodiments for the dispenser without going beyond the ambit of the invention. However, this embodiment of the dispenser, as described in Document FR 2 791 645 is preferred.

The fluid product may also consist in a powder. In this case, the porous material may be omitted.

In the invention, the dispenser assembly further includes packaging 2 which encases the body 10 of the dispenser 1 at least in part. The packaging 2 may be made up of two sheets 21 and 25 between which the body 10 of the dispenser 1 is disposed. The packaging may also be made up of a single sheet folded in half along a fold that forms a straight connection side 20. The sheet(s) may be made of plastic, metal, paper, card, or of a laminated composite film of metal and of plastic.

Advantageously, the dimensions of the sheets are larger than the dimensions of the body 10 of the dispenser 1 so that the body 10 of the dispenser may be disposed between the sheets without protruding therefrom. Preferably, one of the two sheets 25 serves as a backing sheet to which the body 10 of the dispenser is advantageously fixed by adhesive. Thus, the face 11 of the body 10 may be stuck to the backing sheet 25. The other sheet 21 is then folded over onto the backing sheet 25 so as to cover the body 10 of the dispenser. The cover sheet 21 is stuck to the backing sheet 25 over their respective peripheries 22, 26, except for the side 20 along which the two sheets are connected together. The contour of the packaging is thus perfectly flat and thin.

Since the body 10 of the dispenser is substantially flat (about 2 mm thick), the backing sheet 25 and the cover sheet 21 remain relatively plane, or rather they are only slightly curved. A dispenser assembly is thus obtained that is extremely flat, with faces that are substantially plane. The essential requirement is that at least one of the two faces of the dispenser assembly is substantially plane. But in practice, with a dispenser as described above, both faces of the dispenser assembly are substantially plane.

According to another characteristic of the invention, the removable closure member is received in an opening portion 24, 28; 240, 280 formed by the packaging 2.

Figure 2:
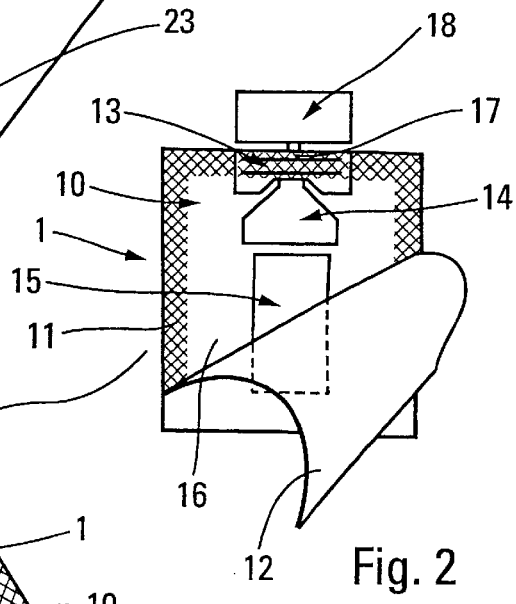
FIG. 2 is a plan view of a fluid dispenser used in the dispenser assembly of the present invention.
Figure 3:
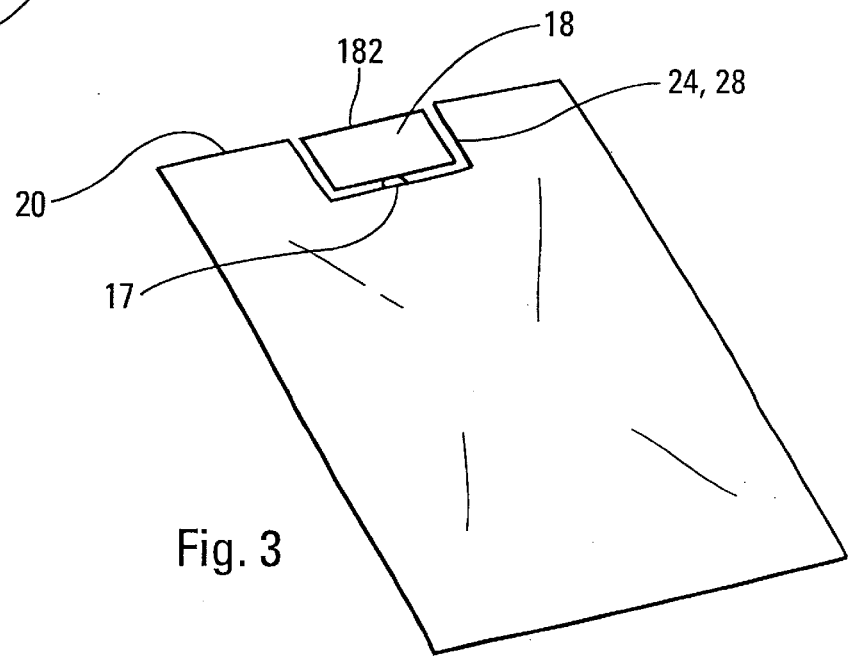
FIG. 3 is a perspective view of a dispenser assembly of the invention in the finished state.

In a first embodiment of the invention shown in FIGS. 1 to 3, the removable closure member 18 is received in a recesss which is formed by a window cut out on the connection where the two sheets meet, i.e. on side 20. Thus, the recess comprises a window portion 24 formed by the cover sheet 21 and another window portion 28 formed by the backing sheet 25. Once the two sheets have been folded over and fixed to each other, the window is transformed into a recess cut out in the side 20, as can be seen in FIG. 3. The removable closure member 18 advantageously lies entirely within the recess 24, 28 and preferably its free end 182 is situated substantially in alignment with the side 20. The dispensing orifice 17 formed by the support part 13 for supporting the body 10 is advantageously situated level with the bottom of the recess 24, 28. By disposing the removable closure member 18 in the recess, said member is well protected and there is no risk of it being a impediment or of it being accidentally torn off. In addition, the dispenser assembly retains a configuration that is almost exactly rectangular or square, since the removable closure member almost completely fills in the recess formed by the packaging 2.

When a user wishes to use such a dispenser assembly, the user needs merely to remove the removable closure member 18 and to press on the packaging so as to push in the actuating wall 19 formed by one face or both faces of the body 10.

Figure 4:
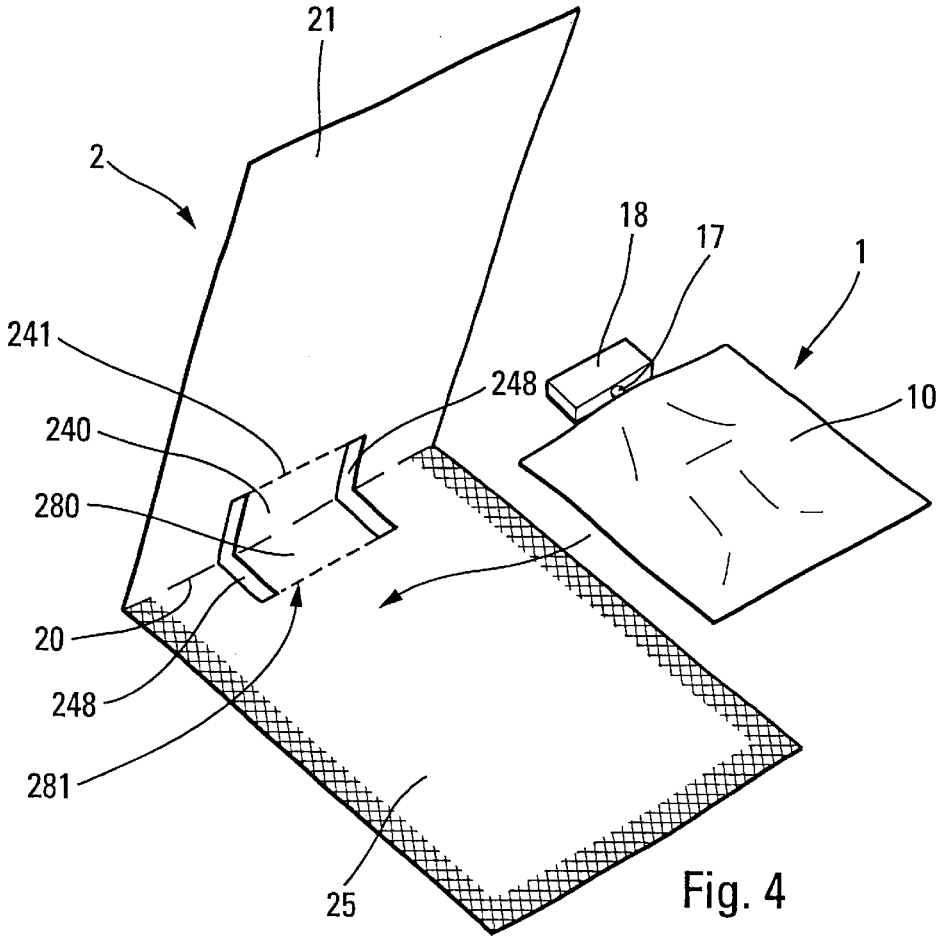
FIG. 4 is a perspective view of a second embodiment of a dispenser assembly of the invention, while it is being assembled.
Figure 5:
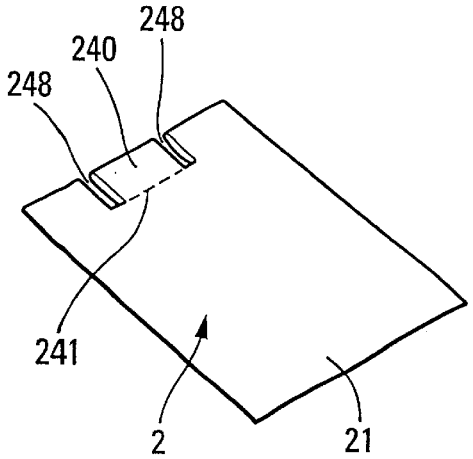
FIG. 5 is a view of the FIG. 4 assembly in the finished state and on a smaller scale.
Figure 6:
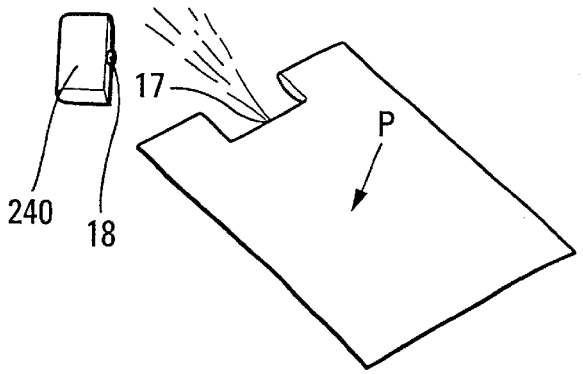
FIG. 6 is a view similar to the FIG. 5 view, with the opening portion and the removable closure member removed.

In a second embodiment shown in FIGS. 4 to 6, the removable closure member 18 is encased in an opening portion formed by the sheets 21 and 25. More precisely, the sheets 21 and 25 define two flaps 240, 280 that are mutually superposed when the cover sheet 21 is folded over onto the backing sheet 25. In this example, the flaps 240, 280 are defined in part by lines of least resistance 241, 281, and by slots 248. Once the packaging is closed, as shown in FIG. 5, the two superposed flaps 240, 280 form a tab enclosing the removable closure member and defined by the slots 248 folded in half and by the superposed break starter lines 241, 281. In the embodiment shown in FIGS. 4 to 6, the opening portion is situated on the side 20, so that the flaps 240, 280 form a single piece. Naturally, it is possible for the opening portion to be disposed on some other side of the packaging 2.

To use this dispenser assembly, the user takes hold of the tab forming the opening portion and detaches it along the break starter line, thereby simultaneously removing the removable closure member that it encases.

With a dispenser assembly of the invention, it is very easy to store it in a feed bin for a machine provided with a suction-pad system for taking hold of it and placing it in a magazine.

Although the dispenser assembly shown in the drawings is rectangular or square in shape, it is possible to consider other geometrical shapes for it, such as polygonal, round, oval, or elliptical. One of the principles of the invention lies in the fact that the assembly has at least one substantially plane face and/or an opening portion in which the removable closure member is received.

What is claimed is:

1. A fluid dispenser assembly characterized in that it comprises:

a fluid dispenser (1) defining a substantially flat body (10) provided with a dispensing orifice (17) and with a removable closure member (18) suitable for closing the dispensing orifice (17), said closure member extending in line with the orifice and the flat body and packaging (2) encasing the dispenser (1) and forming an opening portion (24, 28; 240, 280) in which the removable closure member (18) is received so that it is possible to take hold of it in order to remove it from the body, thereby unmasking the dispensing orifice.

2. A dispenser assembly according to claim 1, in which the opening portion is provided with a recess (24, 28) in which the removable closure member (18) is received in a manner such as to be visible.

3. A dispenser assembly according to claim 1, in which the opening portion (240, 280) encases the removable closure member (18) at least in part.

4. A dispenser assembly according to claim 3, in which the opening portion (240, 280) is defined by at least one line of least resistance (241, 281) so that the opening portion can be detached, together with the removable closure member, from the remainder of the packaging.

5. A dispenser assembly according to claim 3, in which the opening portion (240, 280) is defined by at least one slot (248).

6. A dispenser assembly according to claim 1, in which the packaging is made up of a backing sheet (25) and of a cover sheet (21), the dispenser (1) being fixed to the backing sheet (25) and the cover sheet being fixed to the backing sheet over the peripheries (22, 26) of said sheets.

7. A dispenser assembly according to claim 6, in which the backing sheet and the cover sheet are made integrally and are folded along one side (20).

8. A dispenser assembly according to claim 7, in which the opening portion (24, 28; 240, 280) is situated on said one side (20).

9. A dispenser assembly according to claim 8, in which the removable closure member (18) is provided with a free edge (182) that extends substantially in alignment with said one side (20).

10. A dispenser assembly according to claim 6, in which at least one of the sheets (21, 25) is substantially plane.

11. A dispenser assembly according to claim 6, in which the dispensing orifice (17) is situated on one edge of the opening portion.

12. A dispenser assembly according to claim 6, in which the opening portion is formed by a respective cutout (24, 28; 241, 281, 248) of the backing and cover sheets, said cutouts over lapping when said cover sheet is disposed on the backing sheet.

13. A dispenser assembly according to claim 1, in which the removable closure member (18) lies entirely within the opening portion (24, 28; 240, 280).

14. A dispenser assembly according to claim 1, in which the body (10) defines an actuating wall (19) that can be pressed to drive the fluid out through the dispensing orifice, it being possible to actuate said actuating wall through the packaging.

15. The dispenser assembly according to claim 1, in which the opening portion (24, 28; 240, 280) is disposed on one side of the packaging (20).

16. A fluid dispenser assembly characterized in that it comprises:

a fluid dispenser (1) defining a substantially flat body (10) provided with a dispensing orifice (17) and with a removable closure member (18) suitable for closing the dispensing orifice (17); and packaging (2) encasing the dispenser (1) and forming an opening portion (24, 28; 240, 280) in which the removable closure member (18) is received so that it is possible to take hold of it in order to remove it from the body, thereby unmasking the dispensing orifice; and wherein the opening portion (240, 280) encases the removable closure member (18) at least in part; and wherein the opening portion (240, 280) is defined by at least one slot (248).

17. A fluid dispenser assembly characterized in that it comprises:

a fluid dispenser (1) defining a substantially flat body (10) provided with a dispensing orifice (17) and with a removable closure member (18) suitable for closing the dispensing orifice (17); and packaging (2) encasing the dispenser (1) and forming an opening portion (24, 28; 240, 280) in which the removable closure member (18) is received so that it is possible to take hold of it in order to remove it from the body, thereby unmasking the dispensing orifice; and wherein the opening portion (240, 280) encases the removable closure member (18) at least in part;

wherein the opening portion (24, 28; 240, 280) is situated on said one side (20); and wherein the removable closure member (18) is provided with a free edge (182) that extends substantially in alignment with said one side (20).

* * * * *